US005645655A

United States Patent [19]

Gross et al.

[11] Patent Number: 5,645,655

[45] Date of Patent: Jul. 8, 1997

[54] PROCESS TO ANNEAL STEEL STRIPS IN AN ANNEALING FURNACE WITHOUT GENERATING CARBON BLACK

[75] Inventors: Gerhard Gross, Willich; Peter Zylla, Krefeld, both of Germany

[73] Assignee: Messer Greiesheim GmbH, Frankfurt, Germany

[21] Appl. No.: 488,776

[22] Filed: Jun. 8, 1995

Related U.S. Application Data

[63] Continuation of PCT/EP93/03334, Nov. 27, 1993, published as WO94/13843, Jun. 23, 1994.

[30] Foreign Application Priority Data

Dec. 11, 1992 [DE] Germany ..... 42 41 746.5

[51] Int. Cl.[6] ..... C21D 1/76

[52] U.S. Cl. ..... 148/634

[58] Field of Search ..... 148/634

[56] References Cited

U.S. PATENT DOCUMENTS 3,531,333 9/1970 Hill ..... 148/16.7

FOREIGN PATENT DOCUMENTS 0 156 147 10/1985 European Pat. Off. .

0 405 092 1/1991 European Pat. Off. .

39 34 474 12/1990 Germany .

OTHER PUBLICATIONS

"Cahiers D'Informations Techniques De La Revue De Metallurgie", vol. 86, No. 2 (1989), pp. 173–180.

"High performance hydrogen annealing technology ", Iron and Steel Engineer, vol. 65, No. (Aug. 1988) pp. 43–49.

*Primary Examiner*—Deborah Yee

*Attorney, Agent, or Firm*—Connolly & Hutz

[57] ABSTRACT

A process to anneal a steel strip in an annealing furnace in an inert-gas atmosphere containing hydrogen, with reduced formation of carbon black and encompassing the phases of heating, retention and cooling, wherein on the surface of the steel strip are impurities containing carbon components, and wherein during the annealing, there is a reaction between the $H_2$ and the carbon components of the impurities on the surface of the steel strip, whereby said reaction changes the composition of the inert gas atmosphere in the annealing furnace from an inert gas containing $H_2$ into a gas mixture containing $H_2$ and $CH_4$, which forms an $H_2$—$CH_4$ system, and wherein the annealing furnace is flushed during the phase of retention, the phase of cooling, or during both the phases of retention and cooling, as a function of at least one of the thermodynamic limit values of the $H_2$—$C_4$ system.

18 Claims, 1 Drawing Sheet

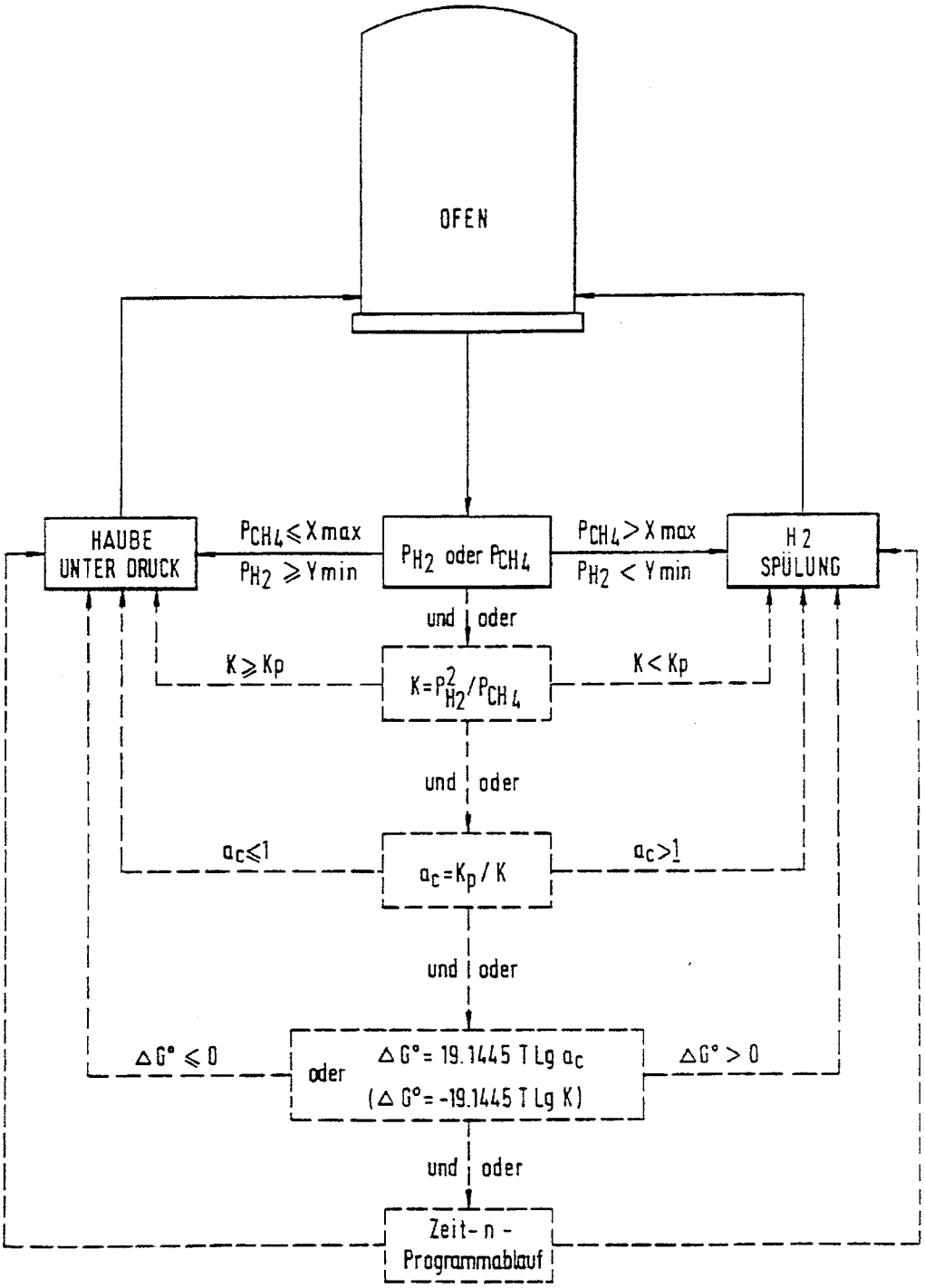
ERSATZBLATT

PROCESS TO ANNEAL STEEL STRIPS IN AN ANNEALING FURNACE WITHOUT GENERATING CARBON BLACK

This application is a continuation of PCT Ser. No. PCT/EP93/03334 filed Nov. 27, 1993 and which has now published, Jun. 23, 1994, WO94/13843.

The invention relates to a process according to anneal steel strips in an annealing furnace in an inert-gas atmosphere containing hydrogen without generating carbon black.

After undergoing cold-rolling, the steel strip in the form of tight coils is annealed in annealing furnaces with intermittent charging, for example, in bell-type furnaces. Normally, $N_2$—$H_2$, Ar—$H_2$ or He—$H_2$ gas mixtures, exothermic atmosphere or pure hydrogen are employed as the inert gas. The use of hydrogen ($H_2$) entails certain advantages such as, for instance, shorter time sequences, avoidance of oxidation of the steel strips or a greater level of cleanliness of the strips. The level of cleanliness of the strips during annealing is dependent on the evaporation behavior of the rolling oil or rolling emulsion, on the quality, composition and flushing volume of the inert gas as well as on the annealing temperature. Due to the long retention times entailed by the annealing process, diffusion phenomena can occur, which lead, among other things, to the formation of carbon deposits which are difficult to remove. The use of hydrogen serves, among other things, to react these deposits to form methane. This process often gives rise to uncontrolled deposits of carbon black which are likewise to be considered as a contamination of the surface.

The invention has the objective of providing a process which ensures a high level of cleanliness of the steel strip heat-treated in an annealing furnace and which optimizes the consumption of inert gas.

On the basis of the state of the art in annealing steel strips in an annealing furnace in an inert-gas atmosphere containing hydrogen, this objective is achieved by means of flushing the annealing furnace during at least one phase of annealing, wherein the flushing is performed as a function of the thermodynamic limit values of the $H_2$-methane system that results from a reaction between the $H_2$ and the carbon components of impurities on the surfaces of the steel strips and whereby during this reaction the composition of the inert-gas atmosphere in the annealing furnace is changed from an inert gas containing $H_2$ into a gas mixture containing $H_2$ and methane.

One advantageous embodiment of the invention includes the process wherein the thermodynamic limit values of the $H_2$-methane system are monitored and the annealing furnace is flushed during the phases of retention and/or cooling if the value falls outside of the specified upper and lower limits. A second preferred embodiment is the process wherein the thermodynamic limit values of the $H_2$-methane system are ascertained as a time function and the annealing furnace is flushed at prespecified times during the phases of retention and/or cooling. Another advantageous embodiment is the process wherein the inert gas consists of 100% pure hydrogen and the annealing furnace is designed as a bell-type furnace, preferably as a high-convection furnace.

Another advantageous embodiment of the process is characterized in that the impurities on the surface of the steel strip are flushed out of the annealing furnace with maximum amounts of inert gas during the heating phase and in that the flushing procedure is triggered with the beginning of the phase. A further preferred embodiment is characterized in that carbon as a crack product is reacted with hydrogen to form methane, preferably during the retention time while the outlet of the annealing furnace is closed, and the methane thus formed is removed in cycles from the annealing furnace.

Another preferred embodiment is the process characterized in that the concentration of methane and/or hydrogen is measured. A further advantageous embodiment is the process characterized in that the annealing furnace is automatically flushed with the inert gas being used whenever the value exceeds the permissible methane concentration or falls below the permissible $H_2$ concentration.

Yet another preferred embodiment is the process characterized in that the regulating variables are values which can be derived from the $H_2$-methane system such as, for example, the equilibrium constant $K_p$, the carbon activity $a_c$, the free enthalpy $\Delta G°$ or a prespecified flushing time. An advantageous embodiment of the invention is the process characterized in that during the retention and cooling phases, the furnace atmosphere is kept at a constant pressure if $PCH_4 \leqq$ X-maximum and/or $PH_2 \geqq$ Y-minimum and/or $K \geqq K_p$ and/or $a_c \leqq 1$ and/or $\Delta G° \geqq 0$.

Another advantageous embodiment is the process characterized in that when $PCH_4$>X-maximum and/or $PH_2$<Y-minimum and/or $K<K_p$ and/or $a_c>1$ and/or $\Delta G°>0$ are reached, the closed outlet on the annealing furnace is automatically opened and the annealing furnace is flushed for a time between ½ and 1½ hours, preferably for approximately 1 hour. Another advantageous embodiment is the process characterized in that the annealing furnace is flushed with an inert gas at a prespecified time, preferably for approximately three hours prior to the end of the retention time.

The flushing procedure introduced by the process according to the invention makes it possible to clean the steel strip while optimizing the consumption of inert gas. Carbon black deposits are avoided by virtue of the fact that limit values for the $H_2$-inert gas system are monitored in the interior of the furnace or, for example, empirically ascertained, and the interior of the furnace is flushed in cycles with inert gas containing hydrogen as the need arises if the limit values are exceeded or when a preset time is reached; this brings about an improvement of the surface quality of the steel strip.

This can be done in that the interior of the furnace is flushed as a function of the thermodynamically permissible content of methane in the inert gas atmosphere during at least one of the phases of heating, retention or cooling, whereby the regulating variables employed to monitor the depositing of carbon black, that is to say, opening of the outlet valve and inert-gas flushing with flushing gas containing hydrogen, are the following:

$a_c$—carbon potential of the furnace atmosphere,

K—equilibrium constant, $\Delta G°$—the free enthalpy of the $H_2$—$CH_4$ system, h—the preprogrammed opening time, $CH_4$—the content of methane in the inert gas atmosphere, and $H_2$—the content of hydrogen in the atmosphere.

These regulating variables are values directly or indirectly derived from the $H_2$—$CH_4$ system formed or else they are points in time which are a thermodynamic function of the $H_2$—$CH_4$ system. Flushing with inert gas, preferably with pure hydrogen, is automatically triggered whenever the value falls outside of the specified upper and lower limits.

The invention will be illustrated below with reference to the drawing and to an embodiment as well as to theoretical considerations involving an inert gas atmosphere containing $H_2$.

The drawing shows the various monitoring possibilities for the cleaning process in the annealing furnace with intermittent charging, preferably in a bell-type furnace, whereby the inert-gas atmosphere of the interior of the furnace is monitored during at least one of the phases of heating, retention or cooling. Values derived directly or indirectly from the $H_2$—$CH_4$ system formed, or points in time which are calculated as a thermodynamic function of the $H_2$—$CH_4$ system serve as the regulating variables which automatically trigger flushing with inert gas whenever the value falls outside of the specified upper and lower limits.

Two temperature ranges can be clearly distinguished for the removal of the rolling oil/emulsion during the annealing process. The limit value is a function of the cracking temperature, which varies from type to type.

Part of the rolling oil/emulsion with a predominantly $C_nH_m$ fraction evaporates within the first temperature segment below the cracking temperature. This phase is completed once the cracking temperature of approximately 450° C. [842° F.] is reached. Since the cracking temperature of the oil/emulsion is reached at different points in time between the edge and the core of the coil, the oil evaporating from the core cracks within the range of the hot, outer edges of the coil. This phase is strongly influenced by the hydrogen serving as the inert-gas atmosphere as a result of more thorough heating of the coil and also due to chemical influences. The vapors are removed from the furnace during flushing.

If the evaporation of the oil/emulsion is shifted far beyond the crack temperature, the carbon produced by the cracking process has to be reacted with hydrogen in order to form methane. This initiates the second phase of the cleaning process:

$$(C)+2H_2—CH_4 \quad (1)$$

This phase is crucial for the final quality of the surface. The thermodynamic states of equilibrium for the formed $H_2$—$CH_4$ system can only be reached during the retention time at a constant temperature.

The capacity to form $CH_4$ depends on the amount of rolling oil/emulsion fed in, that is to say, it is greatly dependent on the surface. Annealing material with large surfaces gives rise to correspondingly high proportions of $CH_4$ or carbon black in the inert-gas atmosphere.

In this context, the thermodynamic conditions do not always allow a complete reaction of the carbon into $CH_4$ during the annealing time.

This directly relates to the instability of hydrocarbons at temperatures above 550° C. [1022° F.].

The reaction equilibrium of the methane decomposition $$CH_4=2H_2+(C) \quad (2)$$

is expressed by means of the equilibrium constant $K_p$:

$$K_p=P^2H_2\cdot a_c/PCH_4,$$

whereby $$Lg\ K_p=Lg(P^2H_2\cdot a_c/PCH_4)=-4791/T+5.789$$

furthermore:

$$Lg\ a_c=Lg(PCH_4/P^2H_2)+Lg\ K_p$$

because:

$$PCH_4/P^2H_2=1/k$$

results in:

$$Lg\ a_c=lg\frac{Kp}{K}$$

$$\boxed{a_c=K_p/K}$$

wherein $K_p$ is the thermodynamic equilibrium,

K is calculated from the measured $H_2$ and $CH_4$ concentrations, $a_c$ is the carbon potential.

The relationship between $K_p$ and the free formation enthalpy is $$K_p=\exp(-\Delta G°/RT)$$

or $$2.3LgK_p=-\Delta G°/RT$$

$$\Delta G°=-2.3RT\ LgK_p$$

wherein

R is the gas constant=1.98585 cal/mol K

1J=1 cal/0.238846

$$\frac{2.3\cdot R}{0.238846}=19.1445\ J/mol\ K$$

$$\boxed{\Delta G° = -19.1445\ T\ Lg\ K_p}$$

Reactions of either methane decomposition or methane formation can take place in the $H_2$—$CH_4$ gas mixture.

| | | |
|---|---|---|
| I. | $CH_4 = 2H_2 + C(in\ \alpha)$ | $\Delta G°\ I = -19.1445\ T\ Lg\ K_I$ |
| II. | $2H_2 + (C) = CH_4$ | $\Delta G°\ II = -19.1445\ T\ Lg\ K_{II}$ |
| | $C = C_{(in\ \alpha)}$ | $\Delta G° = \Delta G°_I + \Delta G°_{II}$ |

With $$K_I=P^2H_2/PCH_4$$

$$K_{II}=PCH_4/P^2H_2\ a_c,$$

the free enthalpy of the system acquires the following form:

$$\Delta G°=-19.1445T[Lg(P^2H_2/PCH_4)+Lg(PCH_4/P^2H_2\cdot a_c)]$$

furthermore $$\boxed{\Delta G° = -19.1445\ T\ Lg\ a_c}$$

Since the free enthalpy of the system is logarithmically dependent on the carbon activity, $$G°<0 \text{ if } a_c<1.$$

In contrast to this, in the case of $a_c>1$, positive values are achieved for $\Delta G°$, whereby the system loses its equilibrium and allows the $CH_4$ excess to decompose according to reaction (2). In this manner, an important condition has been laid down for a process free of carbon black. The free enthalpy of the system will thus be kept negative throughout in that the carbon activity $a_c<1$.

The limit values indicated here were used in the drawing as the regulating variables.

In order to establish a thermodynamic equilibrium, for example, in a 100%—$H_2$ inert-gas atmosphere at a retention temperature of, for instance, 700° C. [1292° F.], a maximum of approximately 11% $CH_4$ is theoretically formed in the case of a sufficient supply of carbon and $a_c$=1. If, however, additional carbon were present in the system, another reaction along the lines of $2\ H_2+(C)\rightarrow CH_4$ would immediately cause the decomposition of the $CH_4$. The cleaning procedure can be resumed in the cooling phase. The chemical affinity of the cleaning, however, diminishes drastically as the temperature drops. The thermodynamic equilibrium $K_p$ likewise assumes lower values as the temperature falls. This process continues for as long as the system can ensure a $\Delta G°<0$. Once the limit value $\Delta G°=0$ is exceeded, carbon black deposits occur once again.

These considerations constitute the basis of the invention. They refer to bell-type furnaces, preferably to high-convection furnaces and their annealing processes.

A prerequisite is that the inert-gas flushing process must start immediately after inertization of the bell, that is to say, simultaneously with the beginning of the heating phase. Due to physical constraints (high heat conductivity on the part of the hydrogen), a maximum inert-gas volume is called for here.

After the set temperature has been reached, the volume of inert gas is reduced or the bell is kept under pressure.

Therefore, a maximum volume flow is fed into the furnace during the heating phase. The methane ($CH_4$) formed and the emulsion/oil vapors are removed from the furnace during this phase by means of flushing. The beginning of the retention time initiates a phase which brings about a cleaning of the annealing material as a result of thermodynamic phenomena. Preferably, this phase is monitored in order to prevent any depositing of carbon black. The monitoring possibilities available can be seen in the drawing.

The bell is kept under pressure during the retention time and cooling phase—i.e., the outlet is kept closed and the inlet is kept open. As can be seen in the drawing, the content of $CH_4$ and/or $H_2$ is continuously analyzed by means of direct measurement in the furnace atmosphere. The measuring device for $CH_4$ and/or $H_2$ is equipped with an adjustable minimum-maximum contact. The X-maximum value corresponds to the $CH_4$ concentration which is theoretically established as the limit value in the $H_2$—$CH_4$ equilibrium systems, that is to say, no methane decomposition occurs. As an alternative, it is possible to measure the Y-minimum $H_2$ concentration, whereby Y-minimum=100–X-maximum. This value is likewise dependent on the temperature and pressure and can be derived from the thermodynamic equilibrium. After the X-maximum or Y-minimum values have been reached, the furnace outlet is opened. Methane is flushed out of the furnace at the maximum volume flow. The necessary flushing procedure takes ½ to 1½ hours, depending on the size of the furnace.

Subsequently, the outlet is closed and the cleaning operation, that is to say, reaction of the carbon, is resumed. The flushing takes place in this phase only in cycles as the need arises in the $H_2$—$CH_4$ equilibrium system.

As can be seen in the drawing, the described basic solution of the monitoring system is based on a $CH_4$ and/or $H_2$ measurement. Examples of additional regulating variables to monitor the precipitation of carbon black, that is to say, opening of the outlet valve and inert-gas flushing, are the following:

$a_c$—carbon potential of the furnace atmosphere,

K—equilibrium constant, $\Delta G°$—the free enthalpy of the $H_2$—$CH_4$ system, h—the preprogrammed opening times.

Since, on the basis of the process according to the invention, as a result of this monitoring of the annealing process, the interior of the furnace is only flushed if the abovementioned limit values shown in the drawing are exceeded, with an optimal flushing configuration, the process makes it possible to reduce the annealing costs and to improve the quality of the products thus manufactured.

We claim:

1. A process to anneal a steel strip in an annealing furnace in an inert-gas atmosphere containing hydrogen, with reduced formation of carbon black and encompassing the phases of heating, retention and cooling, wherein on the surface of the steel strip are impurities containing carbon components, and wherein during the annealing, there is a reaction between the $H_2$ and the carbon components of the impurities on the surface of the steel strip, whereby said reaction changes the composition of the inert gas atmosphere in the annealing furnace from an inert gas containing $H_2$ into a gas mixture containing $H_2$ and $CH_4$, which forms an $H_2$—$CH_4$ system, and wherein the annealing furnace is flushed during the phase of retention, the phase of cooling, or during both the phases of retention and cooling, as a function of at least one of the thermodynamic limit values of the $H_2$—$CH_4$ system.

2. The process according to claim 1, wherein the thermodynamic limit values of the $H_2$—$CH_4$ system are monitored and the annealing furnace is flushed during the phases of retention and/or cooling if the value falls outside of the specified upper and lower limits.

3. The process according to claim 1, wherein the thermodynamic limit values of the $H_2$—$CH_4$ system are ascertained as a time function and the annealing furnace is flushed at prespecified times during the phases of retention and/or cooling.

4. The process according to claim 1, wherein the inert gas consists of 100% pure hydrogen and the annealing furnace is designed as a bell-type furnace.

5. The process according to claim 1, wherein the impurities on the surface of the steel strip are flushed out of the annealing furnace with maximum amounts of inert gas during the heating phase and wherein the flushing procedure begins about at the beginning of the heating phase.

6. The process according to claim 1, wherein carbon as a crack product is reacted with hydrogen to form methane and the methane thus formed is removed in cycles from the annealing furnace.

7. The process according to claim 1, wherein the concentration of $CH_4$ and/or $H_2$ is measured.

8. The process according to claim 1, wherein the annealing furnace is automatically flushed with the inert gas being used whenever the value exceeds the permissible methane concentration or falls below the permissible $H_2$ concentration.

9. The process according to claim 1, wherein the, at least one thermodynamic limit value is the equilibrium constant $K_p$, the carbon activity $a_c$, or the free enthalpy $\Delta G°$.

10. The process according to claim 1, wherein during the retention and cooling phases, the furnace atmosphere is kept at a constant pressure if $PCH_4 \leqq$ X-maximum and/or $PH_2 \geqq$ Y-minimum and/or $K \geqq K_p$ and/or $a_c \leqq 1$ and/or $\Delta G° \leqq 0$.

11. The process according to claim 1, wherein when $PCH_4>$X-maximum and/or $PH_2<$Y-minimum and/or $K<K_p$ and/or $a_c>1$ and/or $\Delta G°>0$ are reached, a closed outlet on the annealing furnace is automatically opened and the annealing furnace is flushed for a time between ½ and 1½ hours.

12. The process according to claim 11, wherein the annealing furnace is flushed with inert gas at a prespecified time.

13. The process of claim 1, wherein the free enthalpy of the $H_2$—$CH_4$ system ($\Delta G°$) is maintained at a value>0.

14. The process of claim 4, wherein the annealing furnace is a high-convection furnace.

15. The process of claim 11, wherein the annealing furnace is flushed for approximately 1 hour.

16. The process of claim 12, wherein the prespecified time is approximately three hours prior to the end of the retention phase.

17. A process to anneal a steel strip essentially in an annealing furnace in an inert-gas consisting essentially of hydrogen, with reduced formation of carbon black and encompassing the phases of heating, retention and cooling, wherein on the surface of the steel strip are impurities containing carbon components, and wherein during the annealing, there is a reaction between the $H_2$ and the carbon components of the impurities on the surface of the steel strip, whereby said reaction changes the composition of the inert gas atmosphere in the annealing furnace from an inert gas containing $H_2$ into a gas mixture containing $H_2$—$CH_4$, which forms an $H_2$ and $CH_4$ system, and wherein the annealing furnace is flushed during at least one of the phases of heating, retention, or cooling, as a function of at least one of the thermodynamic limit values of the $H_2$—$C_4$ system, and wherein the annealing furnace is a bell-type furnace.

18. The process of claim 6, wherein carbon is reacted with hydrogen to form methane during the retention phase while any gas outlets of the annealing furnace are closed.

* * * * *